US010619987B1

(12) United States Patent
Kome et al.

(10) Patent No.: US 10,619,987 B1
(45) Date of Patent: Apr. 14, 2020

(54) BLASTHOLE GUARDS AND RELATED SYSTEMS AND METHODS

(71) Applicant: Dyno Nobel Inc., Salt Lake City, UT (US)

(72) Inventors: Cornelis L. Kome, Salt Lake City, UT (US); David Hunsaker, Syracuse, UT (US); Casey L. Nelson, Murray, UT (US); John B. Halander, Salt Lake City, UT (US); Scott Sanderude, Salt Lake City, UT (US)

(73) Assignee: Dyno Nobel Inc., Salt Lake City, UT (US)

( * ) Notice: Subject to any disclaimer, the term of this patent is extended or adjusted under 35 U.S.C. 154(b) by 0 days.

(21) Appl. No.: 16/238,365

(22) Filed: Jan. 2, 2019

(51) Int. Cl.

| | |
|---|---|
| ***F42D 1/18*** | (2006.01) |
| ***F42D 1/10*** | (2006.01) |
| ***F42D 5/00*** | (2006.01) |
| *F42D 3/04* | (2006.01) |

(52) U.S. Cl.
CPC ..... *F42D 1/18* (2013.01); *F42D 1/10* (2013.01); *F42D 5/00* (2013.01); *F42D 3/04* (2013.01)

(58) Field of Classification Search
CPC ..... F42D 1/18; F42D 1/10; F42D 5/00; F42D 3/04
USPC ..... 102/304
See application file for complete search history.

(56) References Cited

U.S. PATENT DOCUMENTS 8,011 A * 4/1851 Monson ..... F42D 1/18 102/333
24,006 A * 5/1859 Buckley ..... F42D 1/18 102/304
30,809 A * 12/1860 Gilleland ..... F42D 5/00 102/301
371,298 A * 10/1887 Bourne ..... F42D 1/10 102/313
1,491,661 A * 4/1924 Bayat ..... F42D 1/18 102/301
1,642,118 A * 9/1927 Lindner ..... F42D 1/18 102/333
1,751,015 A * 3/1930 Mora ..... F42D 1/04 86/21
2,811,839 A * 11/1957 McReynolds, Jr. ..... F42D 1/18 405/15
2,903,969 A * 9/1959 Kolbe ..... F42D 1/10 102/313
2,930,276 A * 3/1960 Smith ..... F42D 1/10 86/20.15

(Continued)

FOREIGN PATENT DOCUMENTS

| | | |
|---|---|---|
| EP | 3140607 | 10/2018 |
| WO | 2019014716 | 1/2019 |

OTHER PUBLICATIONS

Stemming Retainer Plug, Date Unavailable.
Hole Saver photo, Date Unavailable.
Product Photo, Date Unavailable.

*Primary Examiner* — Joshua E Freeman
(74) *Attorney, Agent, or Firm* — Stoel Rives LLP

(57) ABSTRACT

A blasthole guard may include a conduit and a cap. The conduit is sized and shaped to allow a hose to pass through. The cap comprises a funnel that narrows to an open end of the conduit. A slot continuously extends from the conduit through the cap such that the slot forms an opening that extends along an entire length of the device.

20 Claims, 7 Drawing Sheets

(56) References Cited

U.S. PATENT DOCUMENTS 3,148,580 A * 9/1964 Brown ..... F42D 1/10 86/20.15
3,170,366 A * 2/1965 Alfredsson ..... F42D 1/10 86/20.15
3,339,486 A * 9/1967 Rodriquez ..... F42D 5/00 102/301
3,760,727 A * 9/1973 Callister ..... F42B 3/087 102/331
4,003,429 A * 1/1977 Hay ..... E21D 9/006 166/51
4,019,438 A * 4/1977 Swanson, Jr. ..... F42D 1/10 102/331
4,055,122 A * 10/1977 Muldrow, Jr. ..... E21B 43/263 86/20.13
4,250,811 A * 2/1981 MacKey ..... F42B 3/087 102/331
4,798,554 A * 1/1989 Nelson ..... A63H 27/10 446/220
4,976,297 A * 12/1990 Peckels ..... B67C 11/02 116/109
5,035,002 A * 7/1991 Knight, Jr. ..... A41D 25/022 2/137
5,610,358 A * 3/1997 Eagar ..... F42D 1/10 102/313
5,979,327 A * 11/1999 Thomson ..... F42D 1/10 102/333
2004/0092165 A1* 5/2004 Holland ..... H01R 43/26 439/607.01
2009/0090791 A1* 4/2009 Dorenbusch ..... A01G 13/0281 239/1
2009/0182200 A1* 7/2009 Golden ..... A61M 25/09 600/153
2012/0017791 A1* 1/2012 Sloan ..... F42D 1/18 102/304

* cited by examiner

BLASTHOLE GUARDS AND RELATED SYSTEMS AND METHODS

TECHNICAL FIELD

The present disclosure relates generally to explosives. More specifically, the present disclosure relates to a blasthole guard to maintain integrity of a blasthole and reduce wear on a delivery conduit for explosives.

BRIEF DESCRIPTION OF THE DRAWINGS

The embodiments disclosed herein will become more fully apparent from the following description and appended claims, taken in conjunction with the accompanying drawings. The drawings depict primarily generalized embodiments, which embodiments will be described with additional specificity and detail in connection with the drawings in which:

DETAILED DESCRIPTION

Explosives are commonly used in the mining, quarrying, and excavation industries for breaking rocks and ore. Generally, a hole, referred to as a "blasthole," is drilled in a surface, such as the ground. To deliver explosives, a delivery conduit (e.g., hose) is lowered into the blasthole. Explosives may be pumped through the delivery conduit into the blasthole. The delivery conduit is retracted out of the blasthole as the explosives are delivered.

However, lowering the delivery conduit into the blasthole or retracting the delivery conduit out of the blasthole may affect the integrity of the blasthole and may cause damage to the delivery conduit. For example, as the delivery conduit slides across a mound from drilling the blasthole, the delivery conduit may cause debris to fall into the blasthole. Debris falling into the blasthole may trap the delivery conduit within the blasthole. Additionally, an edge of the blasthole or rocks within the mound may be sharp. The sharp edge and rocks may cause wear on the delivery conduit, which may result in premature failure of the delivery conduit.

Described herein is a blasthole guard to maintain the integrity of the hole and reduce wear on the delivery conduit during delivery of explosives. The blasthole guard may include a conduit, a cap that funnels into the conduit, and a slot that continuously extends from the conduit through the cap such that the slot forms an opening that extends along an entire length of the device.

It will be understood that the components of the embodiments as generally described below and illustrated in the figures herein could be arranged and designed in a wide variety of different configurations. For instance, the steps of a method do not necessarily need to be executed in any specific order, or even sequentially, nor do the steps need to be executed only once. Thus, the following more detailed description of various embodiments, as described below and represented in the figures, is not intended to limit the scope of the disclosure, but is merely representative of various embodiments. While the various aspects of the embodiments are presented in drawings, the drawings are not necessarily drawn to scale unless specifically indicated.

The phrases "connected to" and "coupled to" refer to any form of interaction between two or more entities, including mechanical, electrical, magnetic, electromagnetic, fluidic, and thermal interaction. Two entities may interact with each other even though they are not in direct contact with each other. For example, two entities may interact with each other indirectly through an intermediate entity.

The term "proximal" is used herein to refer to "near" or "at" the object disclosed. For example, "proximal the outlet of the delivery conduit" refers to near or at the outlet of the delivery conduit.

Figure 1A:
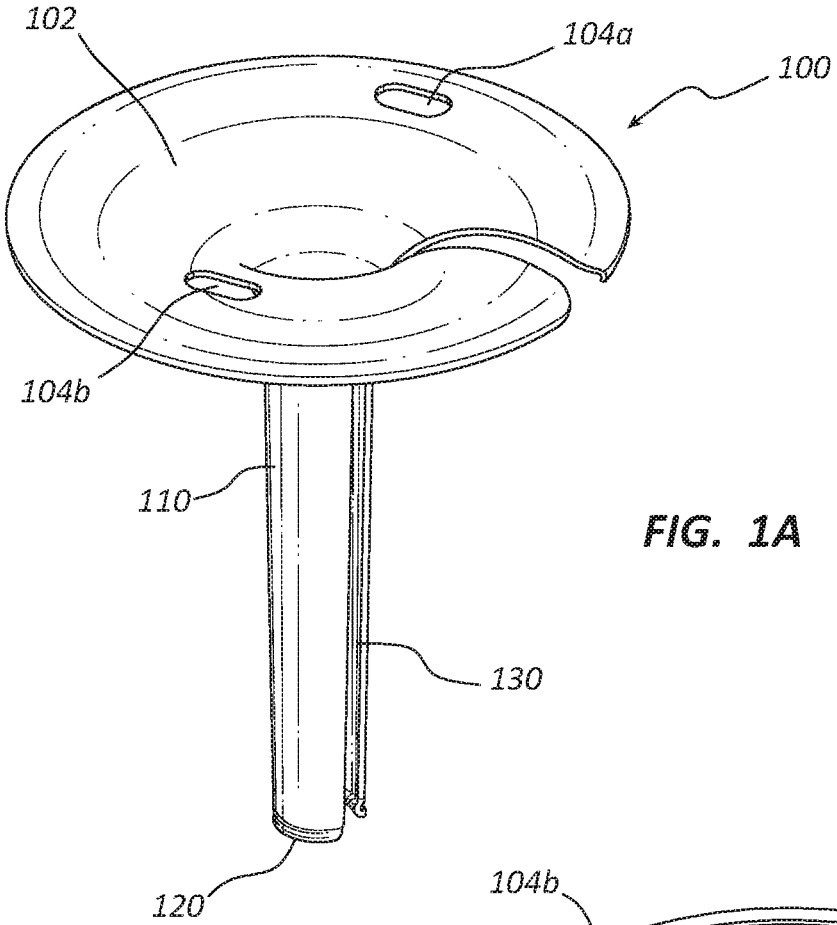
FIG. 1A illustrates a top perspective view of a blasthole guard, according to one embodiment.
Figure 1B:
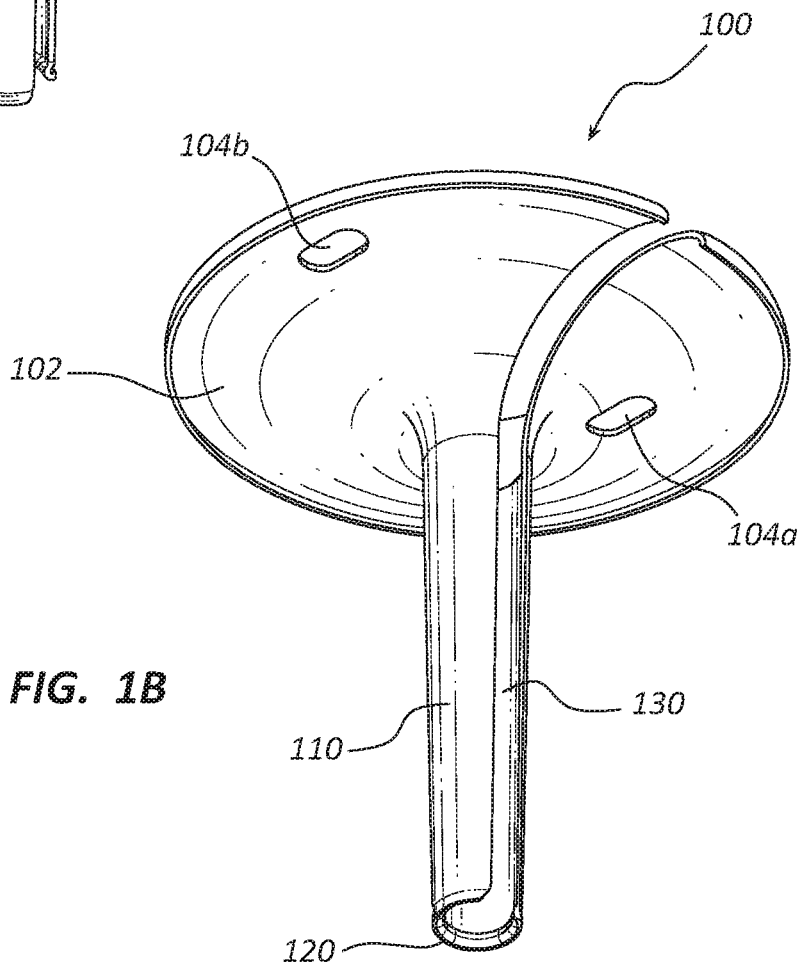
FIG. 1B illustrates a bottom perspective view of the blasthole guard.

Turning now to the figures, FIG. 1A illustrates a top perspective view of a blasthole guard 100. FIG. 1B illustrates a bottom perspective view of the blasthole guard 100. The blasthole guard 100 is a device that can be inserted in a blasthole during delivery of explosives to maintain the integrity of the hole and reduce wear on the delivery conduit. The blasthole guard 100 includes a conduit 110 and a cap 102. A slot 130 may provide an opening along a length of the conduit 110 and cap 102.

The conduit 110 is configured to be at least partially inserted into a blasthole. The conduit 110 comprises a first open end and a second open end and is sized and shaped to allow a delivery conduit (e.g., hose) to pass through the first open end and the second open end. The conduit 110 prevents the delivery conduit from contacting the wall of the blasthole along the length of the conduit 110, and guides the delivery conduit into the blasthole.

The conduit 110 may be a cylinder, and the diameter of the conduit 110 may vary. For example, in some embodiments, the diameter of the conduit 110 is between three and twelve inches. In some embodiments, the diameter of the conduit 110 is between four and ten inches. In some embodiments, the diameter of the conduit 110 is between four and six inches. In some embodiments, the diameter of the conduit 110 is between three and six inches. A user may select a blasthole guard 100 with a diameter that is similar to the diameter of the blasthole to facilitate delivery of explosives.

The cap 102 is coupled to the first open end of the conduit 110. The cap 102 is sized and shaped to limit downward vertical movement of the conduit 110 within a blasthole. For example, as shown, the cap 102 may be a circular shape with a diameter greater than the blasthole to prevent the blasthole guard 100 from falling into the blasthole. The cap 102 may include a concave annulus that funnels into the channel of the conduit 110 and is configured to extend over a mound of the blasthole. A bottom surface (the surface facing toward the conduit 110) of the concave annulus is concave while the top surface (the surface facing away from the conduit 110) of the concave annulus is convex. The convex shape of the top surface acts as a funnel.

The slot 130 and the cap 102 may have a slot that continuously extends from the conduit 110 through the cap 102 such that the slot forms an opening that extends along an entire length of the device. The slot 130 may be configured to receive a detonator cord (electric or NONEL) and allows the blasthole guard 100 to be removed while keeping the detonator cord in place.

The cap 102 may include a first handhold slot 104*a* and a second handhold slot 104*b* (collectively referred to herein as handhold slots 104). The handhold slots 104 may be located at or near the peak of the dome of the cap 102. The placement on top of the dome of the cap 102 may allow a user to insert his or her hands more easily than if the cap 102 was flush with the ground when inserted in a blasthole. The handhold slots 104 may be on opposing sides of the cap 102. The handhold slots 104 may be sized and shaped such that three fingers in a glove may be inserted into the handhold slots 104. The slots 104 are also sized to be engaged with hooks or similar devices to remove or reposition the blasthole guard 100.

The blasthole guard 100 may also include an annular expansion 120 on a distal portion (or outlet) of the conduit 110. The annular expansion 120 may prevent a nozzle of a delivery conduit from getting caught on the distal portion of the conduit 110 by guiding the nozzle into the center of the conduit 110 via beveled edges. In some embodiments, the slot 130 may flare out at the distal edge. In some embodiments, the corners of the slot 130 at the annular expansion 120 and the edge of the cap 102 may be rounded. The rounding and the flare at the distal edge may reduce the chance of a corner catching on the detonator cord.

In some embodiments, as shown, the cap 102 and the conduit 110 may be a single integrated piece of material. The blasthole guard 100 may be a polyolefin material. Exemplary polyolefin materials may be selected from at least one of the following: polyethylene, polypropylene, polyurethane, polystyrene, and UV stabilized ABS. The material used for the blasthole guard 100 may have an inherent lubricity that provides a low friction surface for a delivery conduit to slide on. The blasthole guard 100 may have a durometer hardness within a range of 35 to 90 on the Shore D scale. In other embodiments the blasthole guard 100 may have a durometer hardness within a range of 55 to 75 on the Shore D scale. The blasthole guard 100 may be manufactured using various techniques including rotomolding, injection molding, and blow molding. Alternatively, the blasthole guard 100 can be formed from a single piece of material, such as a polyolefin or fiberglass sheet.

In some embodiments, the blasthole guard 100 is configured to be used as a blasthole guard in a first position and to be used as a safety marker in a second position. For example, the cap 102 can be sized and shaped to serve as a base of the safety marker to support and stabilize the conduit 110, similar to a safety cone. The conduit 110 can be sufficiently rigid to serve as a shaft of the safety marker. In some embodiments, the blasthole guard 100 may be colored orange similar to construction barrels and safety cones.

Figure 2A:
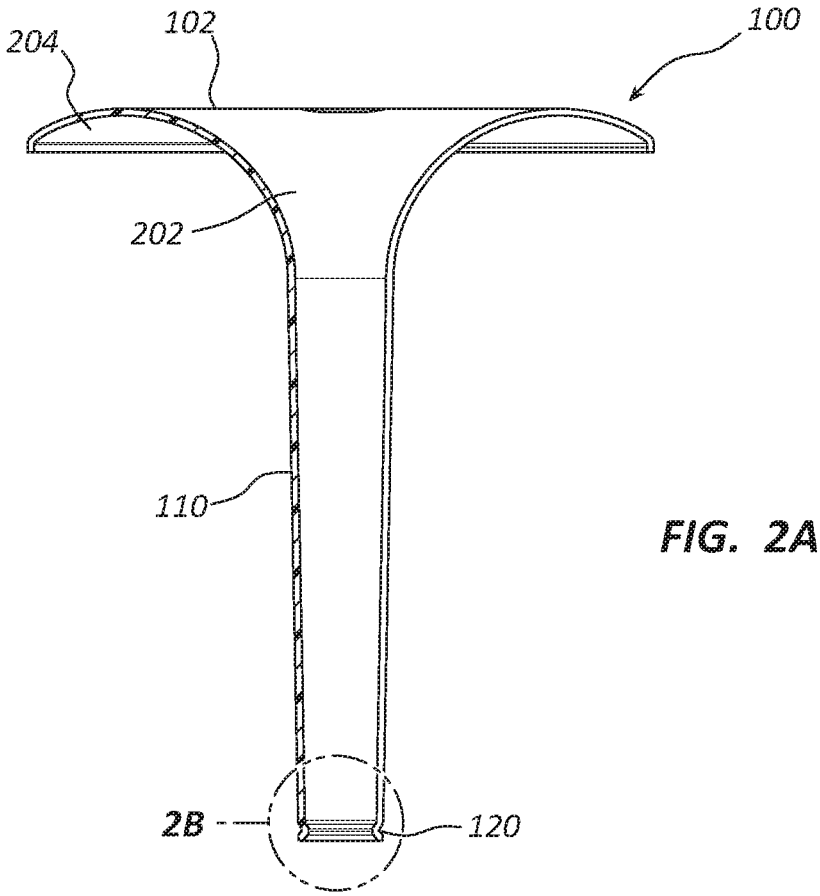
FIG. 2A illustrates a cross-sectional view of the blasthole guard of FIGS. 1A and 1B.

FIG. 2A illustrates a cross-sectional view of the blasthole guard 100 of FIGS. 1A and 1B. As shown, the cap 102 includes a concave annulus 204 and a funnel 202. A bottom surface (the surface facing toward the conduit 110) of the concave annulus 204 is concave while the top surface (the surface facing away from the conduit 110) of the concave annulus 204 is convex. The convex shape of the top surface acts as a funnel. The funnel 202 may continue the arch of the concave annulus 204 and extend to the conduit 110. In other words, the convex top surface of the concave annulus 204 arches to meet with an inner surface of the funnel 202. The funnel 202 guides delivery conduits into the conduit 110. The conduit 110 may line an initial portion of a blasthole.

The funnel 202 and concave annulus 204 may also provide a smooth surface surrounding the conduit 110 on which the delivery conduit may be moved with little wear. For example, as the delivery conduit is lowered into the blasthole or retracted from the blasthole, the concave annulus 204 may prevent the delivery conduit from contacting a sharp edge of the blasthole or debris surrounding the blasthole.

Further, the concave annulus 204 may extend from the funnel 202 and be configured to cover a mound of the blasthole. Debris falling into the blasthole may trap the delivery conduit. If the delivery conduit were in contact with the mound as the delivery conduit is lowered into the blasthole or retracted from the blasthole, the debris in the mound may fall into the blasthole. By covering the mound and blocking the edges of the blasthole, the concave annulus 204 and funnel 202 may prevent debris from falling into the blasthole.

Figure 2B:
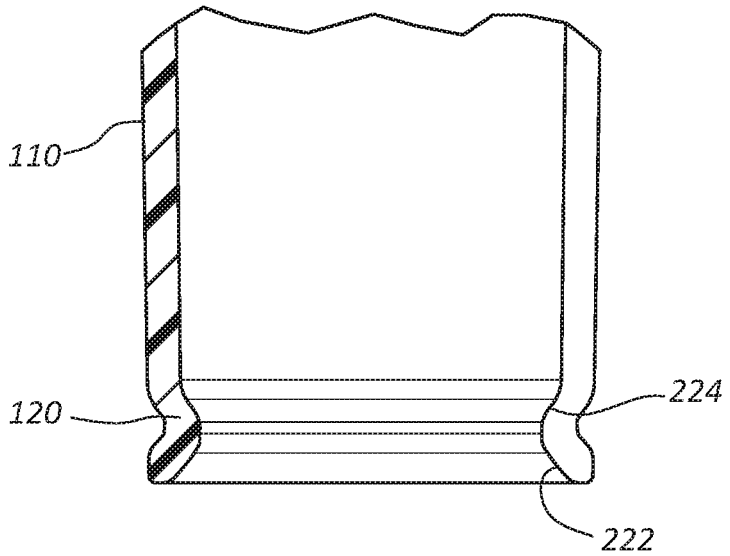
FIG. 2B illustrates a partially cut-away cross-sectional view of the annular expansion of the conduit of FIG. 2A.

The illustrated embodiment of the blasthole guard 100 also includes an annular expansion 120 to guide a delivery conduit and nozzle into and out of the conduit 110. FIG. 2B illustrates a close-up, partially cut-away cross-sectional view of the annular expansion 120 of the conduit 110 of FIG. 2A. As shown, the annular expansion 120 may be a ring on a distal portion of the conduit 110. The annular expansion 120 may include features that expand inward toward the center of the conduit 110 and/or outward. In some embodiments, the annular expansion 120 may extend beyond the diameter of the conduit 110.

In the illustrated embodiment, the annular expansion 120 features an inverted rib with a first beveled edge 224 and a second beveled edge 222 (collectively referred to herein as beveled edges 222, 224). The beveled edges 222, 224 angle from the larger diameter of the conduit 110 to the smaller diameter of the annular expansion 120. In some embodiments, the annular expansion 120 may include a single beveled edge.

The beveled edges 222, 224 guide a delivery conduit and nozzle through the opening of the conduit 110, thereby preventing the nozzle from getting caught on an edge of the conduit 110. For example, as the nozzle is retracted from the hole, the second beveled edge 222 directs the movement of the nozzle inward. Similarly, as the nozzle is placed into the hole, the first beveled edge 224 directs the movement of the nozzle inward.

Figure 3:
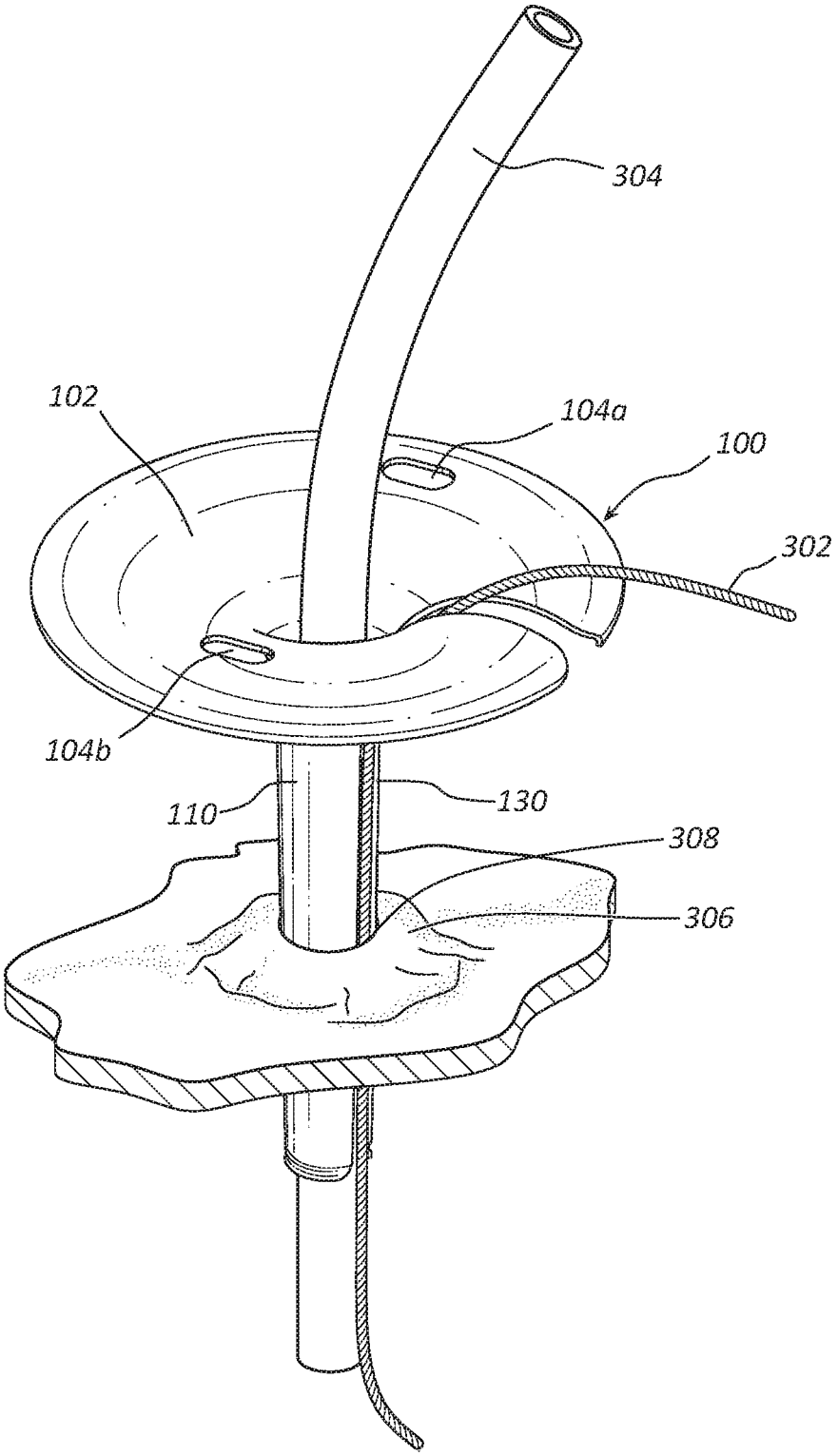
FIG. 3 illustrates a perspective view of a blasthole guard being placed within a blasthole.

FIG. 3 illustrates a perspective view of a blasthole guard 100 being placed within a blasthole 308. For clarity, FIG. 3 illustrates the blasthole guard 100 partially dislodged from the blasthole 308. A delivery conduit 304 is inserted in the blasthole guard 100, and a detonator cord is received by the slot 130 of the blasthole guard 100.

As shown, the conduit 110 is configured to be inserted into the blasthole 308. The conduit 110 is a sleeve for the initial portion of the blasthole 308 and provides a smooth surface for the delivery conduit 304. The conduit 110 has a diameter that is smaller than the diameter of the blasthole 308. The blasthole guards 100 with various conduit diameters may be manufactured to accommodate potential blasthole sizes. For example, in some embodiments, the diameter of the conduit 110 is between three and twelve inches. In some embodiments, the diameter of the conduit 110 is between four and ten inches. In some embodiments, the diameter of the conduit 110 is between four and six inches. In some embodiments, the diameter of the conduit 110 is between three and six inches.

The cap 102 is a domed funnel, that is, the cap 102 tapers a center hole to the diameter of the conduit 110 and has edges that arch to form a concave annulus around the tapered center hole. The domed shape of the cap 102 may cover the periphery of the blasthole, including a mound 306, when the blasthole guard 100 is completely inserted in the blasthole 308. By covering the mound 306, the cap 102 may prevent the delivery conduit 304 from disturbing the mound 306. If the delivery conduit 304 were allowed to run through or over the mound 306, rocks, dirt, and other debris could fall in the blasthole 308 and pin the delivery conduit 304 in the hole.

The slot 130 receives a detonator cord 302. As the detonator cord 302 is within the slot 130, the delivery conduit 304 may be less likely to pull on or otherwise agitate the detonator cord 302. The slot 130 also permits the blasthole guard 100 to be removable with the detonator cord 302 in place after loading the blasthole 308 with explosives. The slot 130 may be narrower than a diameter of the delivery conduit 304 and wider than a diameter of the detonator cord 302. For example, the slot 130 may have a width between one and three inches. The slot 130 may have rounded or flared corners to prevent snagging on the detonator cord 302.

The material of the blasthole guard 100 may have inherent lubricity to allow the delivery conduit 304 to easily slide along the conduit 110 and the cap 102. Other than the slot 130, which may be too small for the delivery conduit 304 to enter, the conduit 110 and the cap 102 completely surround the delivery conduit 304. Thus, the delivery conduit 304 may be pulled from or fed into the blasthole 308 from any angle.

Figure 4:
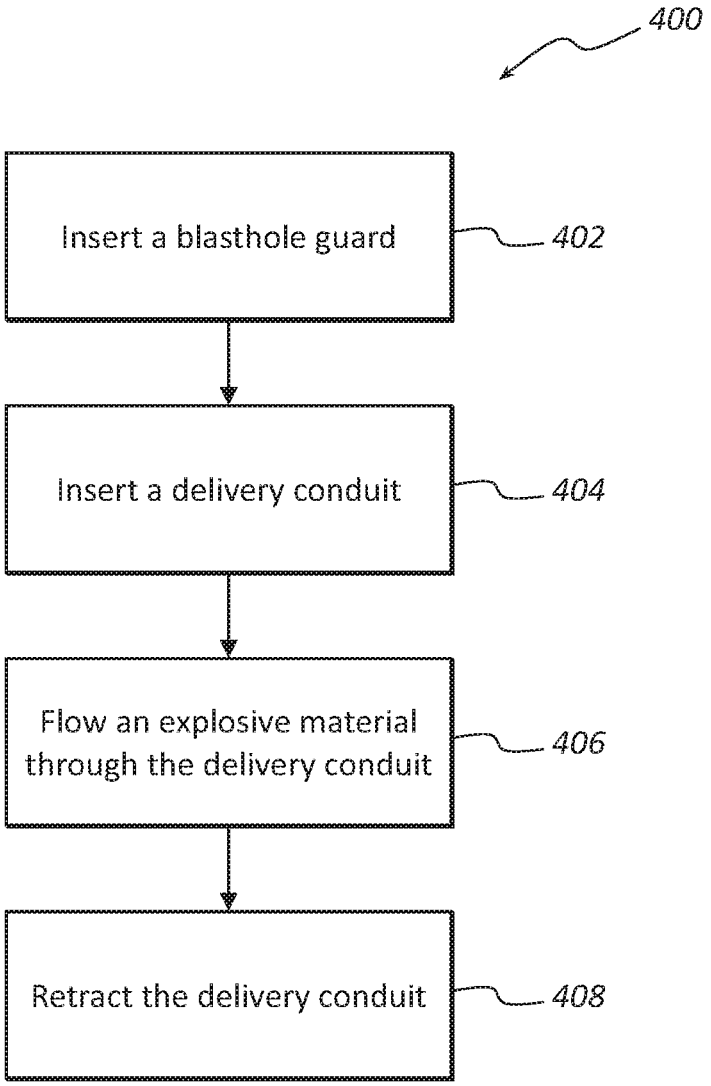
FIG. 4 is a flow diagram of a method for delivering an explosive material into a blasthole according to one embodiment.

FIG. 4 is a flow diagram of a method 400 for delivering an explosive material into a blasthole according to one embodiment. A user may insert 402 a blasthole guard into a blasthole. The blasthole guard may include a guard conduit configured to extend into the blasthole, and a cap coupled to the conduit. The cap may include a concave annulus that funnels into a channel of the guard conduit and extends over a mound of the blasthole. The cap is sized and shaped to limit downward vertical movement of the guard conduit within a blasthole.

A user may insert 404 a delivery conduit through the guard conduit into the blasthole. The user may flow 406 an explosive material through the delivery conduit, and retract 408 the delivery conduit from the blasthole through the blasthole guard. When the delivery conduit is retracted, the delivery conduit may slide across a portion of the concave ring of the cap.

In some embodiments, the blasthole guard inserted into the blasthole further comprises a slot that continuously extends through the guard conduit and the cap such that the slot extends along an entire length of the blasthole guard. In these embodiments, the method may further include inserting a detonator cord into the blasthole, and aligning the slot in the blasthole guard with the detonator cord.

Figure 5:
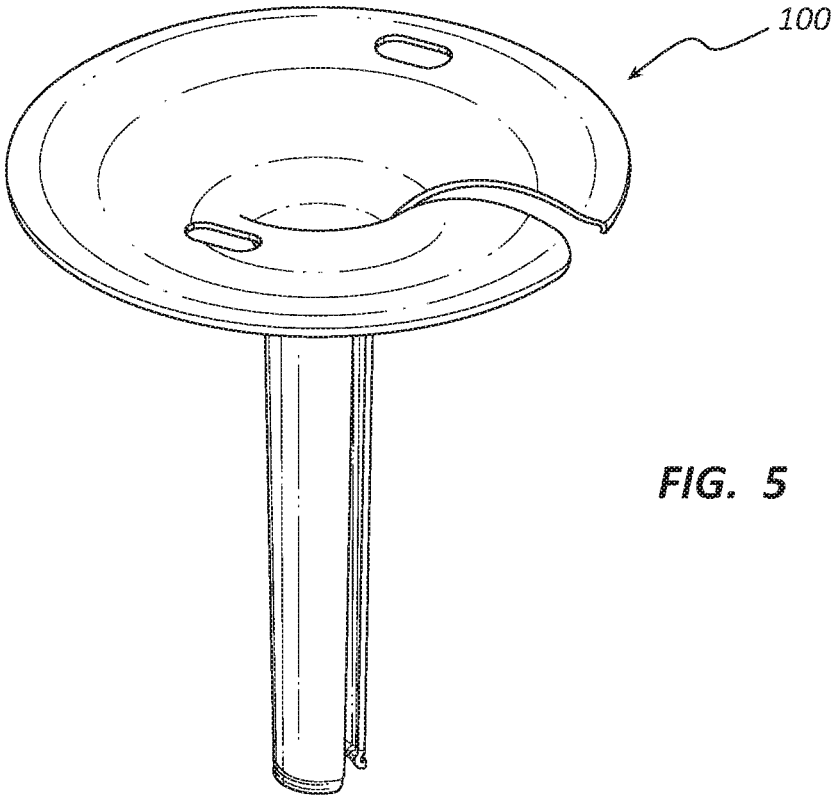
FIG. 5 illustrates a top perspective view of a blasthole guard.

FIG. 5 illustrates a top perspective view of a blasthole guard 100, according to one embodiment.

Figure 6:
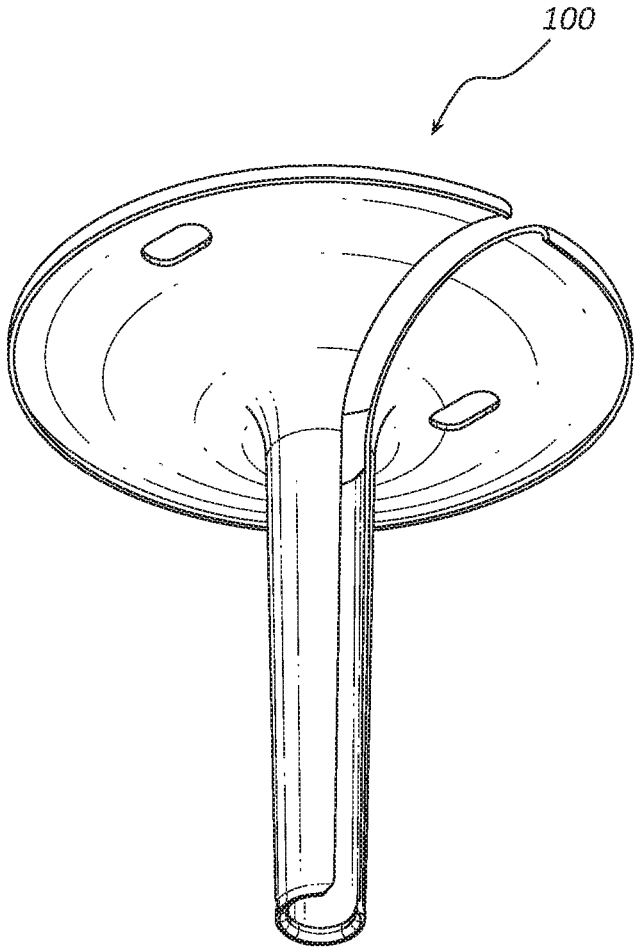
FIG. 6 illustrates a bottom perspective view of a blasthole guard.

FIG. 6 illustrates a bottom perspective view of a blasthole guard 100, according to one embodiment.

Figure 7:
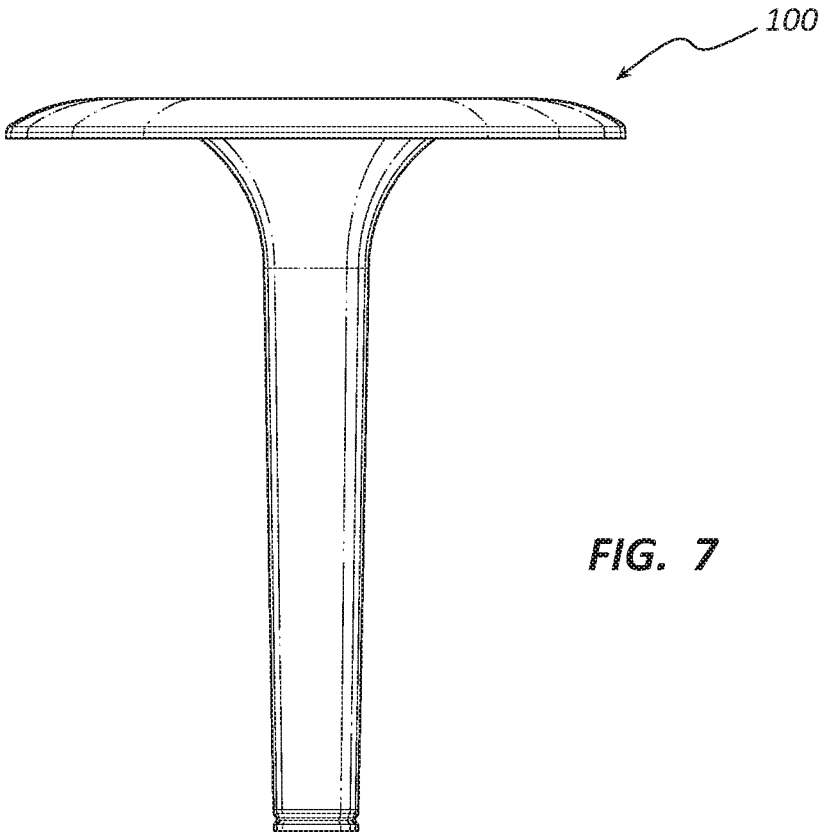
FIG. 7 illustrates a first side view of a blasthole guard.

FIG. 7 illustrates a first side view of a blasthole guard 100, according to one embodiment.

Figure 8:
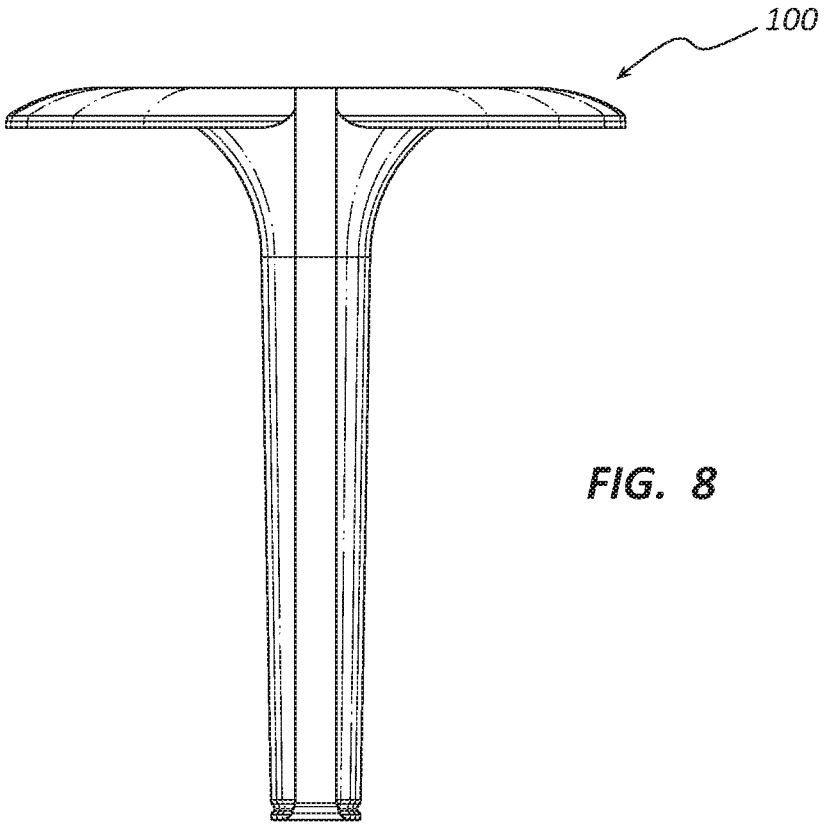
FIG. 8 illustrates a second side view of a blasthole guard.

FIG. 8 illustrates a second side view of a blasthole guard 100, according to one embodiment.

Figure 9:
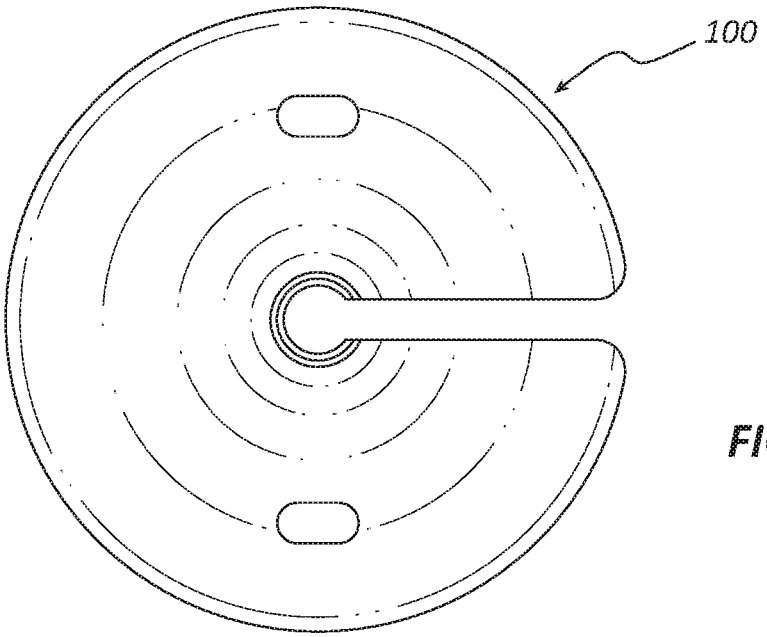
FIG. 9 illustrates a top planar view of a blasthole guard.

FIG. 9 illustrates a top planar view of a blasthole guard 100, according to one embodiment.

Figure 10:
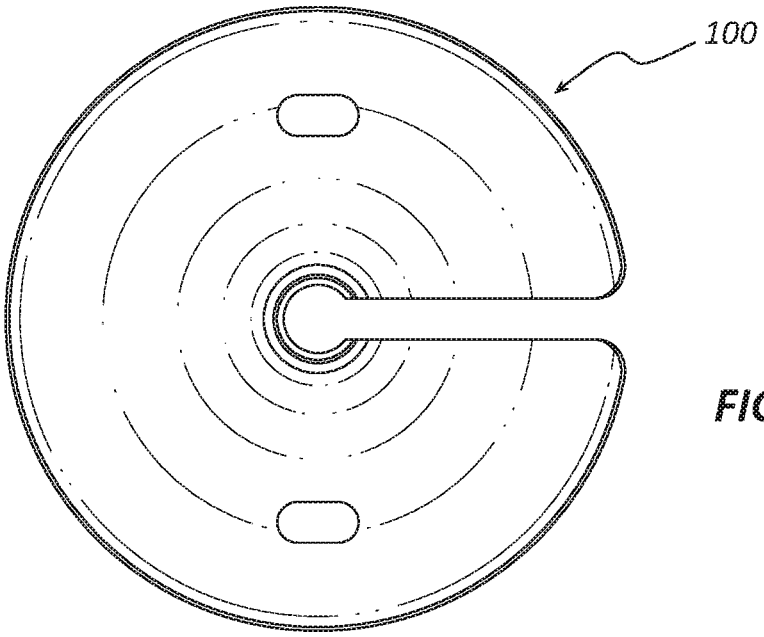
FIG. 10 illustrates a bottom planar view of a blasthole guard.

FIG. 10 illustrates a bottom planar view of a blasthole guard 100, according to one embodiment.

One of ordinary skill in the art, with the benefit of this disclosure, would understand that the systems and methods disclosed herein may also include other components and method steps. The examples and embodiments disclosed herein are to be construed as merely illustrative and exemplary and not a limitation of the scope of the present disclosure in any way. It will be apparent to those having skill in the art, and having the benefit of this disclosure, that changes may be made to the details of the above-described embodiments without departing from the underlying principles of the disclosure herein.

The invention claimed is:

1. A device for insertion in a blasthole during delivery of explosives, the device comprising:

a conduit with a slot along a length of the conduit, wherein the conduit comprises a first open end and a second open end, wherein the conduit is sized and shaped to allow a hose to pass through the first open end and the second open end; and a cap coupled to the first open end of the conduit, the cap comprising a funnel that narrows to the first open end of the conduit, wherein the cap is sized and shaped to limit downward vertical movement of the conduit within a blasthole, wherein the slot continuously extends from the conduit through the cap such that the slot forms an opening that extends along an entire length of the device.

2. The device of claim 1, wherein the cap further comprises an annulus that extends from the funnel, wherein the annulus comprises a concave surface facing toward the conduit and a convex surface facing away from the conduit, wherein the annulus is configured to cover a periphery of the blasthole, wherein the slot further extends through the annulus.

3. The device of claim 1, further comprising an annular expansion at the second open end.

4. The device of claim 3, wherein the annular expansion comprises a beveled interior surface.

5. The device of claim 1, wherein the cap further comprises a second slot and a third slot on the cap for handholds.

6. The device of claim 1, wherein the conduit and cap are rotomolded.

7. The device of claim 1, wherein the conduit and cap are constructed of a polyolefin.

8. The device of claim 1, wherein the device is configured to be used as a blasthole guard in a first position and be used as a safety marker in a second position, wherein the cap is sized and shaped to serve as a base of the safety marker and the conduit is sufficiently rigid to serve as a shaft of the safety marker.

9. The device of claim 1, wherein the slot is sized and shaped to receive a detonator cord.

10. The device of claim 1, wherein the slot has a width between one and three inches.

11. The device of claim 1, wherein the conduit has a diameter between three and twelve inches.

12. The device of claim 1, wherein the conduit has a diameter between four and ten inches.

13. The device of claim 1, wherein the conduit has a diameter between four and six inches.

14. The device of claim 1, wherein the conduit has a diameter between three and six inches.

15. A method for delivering an explosive material into a blasthole, the method comprising:

inserting a blasthole guard into a blasthole, the blasthole guard comprising:

a guard conduit configured to extend into the blasthole, and a cap coupled to the conduit, the cap comprising an annulus comprising a concave surface facing toward the guard conduit and a convex surface facing away from the guard conduit, wherein the annulus funnels into a channel of the guard conduit and extends over a periphery of the blasthole, wherein the cap is sized and shaped to limit downward vertical movement of the guard conduit within a blasthole;

inserting a delivery conduit through the guard conduit into the blasthole;

flowing an explosive material through the delivery conduit; and retracting the delivery conduit from the blasthole through the blasthole guard.

16. The method of claim 15, wherein the blasthole guard inserted into the blasthole further comprises a slot that continuously extends through the guard conduit and the cap such that the slot extends along an entire length of the blasthole guard.

17. The method of claim 16, further comprising:

inserting a detonator cord into the blasthole; and aligning the slot in the blasthole guard with the detonator cord.

18. The method of claim 17, further comprising:

removing the blasthole guard while maintaining the detonator cord in the blasthole.

19. The method of claim 15, wherein the blasthole guard inserted into the blasthole is a single integrated piece.

20. The method of claim 15, wherein when the delivery conduit is retracted, the delivery conduit slides across a portion of the concave annulus.

* * * * *